US005113791A

United States Patent [19]

Rottschafer

[11] Patent Number: 5,113,791

[45] Date of Patent: May 19, 1992

[54] OUTBOARD MOTOR STOWING BRACKET FOR SLOTTED SWIM PLATFORM

[75] Inventor: William A. Rottschafer, Holland, Mich.

[73] Assignee: Kwik Mount, Inc., Grand Rapids, Mich.

[21] Appl. No.: 622,743

[22] Filed: Dec. 5, 1990

[51] Int. Cl.[5] ..... B63B 17/00

[52] U.S. Cl. ..... 114/362; 248/642

[58] Field of Search ..... 114/362, 373; 440/53, 440/63, 900; 248/640–643

[56] References Cited

U.S. PATENT DOCUMENTS

| | | | |
|---|---|---|---|
| 2,231,277 | 2/1941 | Mepham | 248/643 |
| 2,686,028 | 8/1954 | Johnson | 248/643 |
| 4,824,067 | 4/1989 | O'Brien | 440/900 |

*Primary Examiner*—Jesûs D. Sotelo
*Attorney, Agent, or Firm*—Waters & Morse

[57] ABSTRACT

An outboard motor for a dinghy is stowed on the swimming platform of a boat during periods of which the dinghy is being towed, or stored. An adjustable bracket securable to the swimming platform provides a vertical panel disposed in the front-rear direction for receiving the mounting clamp of the outboard motor, which positions the motor crosswise with respect to the boat, and in a position shielded from spray or other accident. The mounting bracket has an angular cross section providing a base flange having openings that register with the usual open structure of the swimming platform for receiving bolts holding the bracket in position. A pad is securable to the propeller drive housing, and interposed between the housing and the surface of the swimming platform to protect both the platform and the motor.

9 Claims, 2 Drawing Sheets

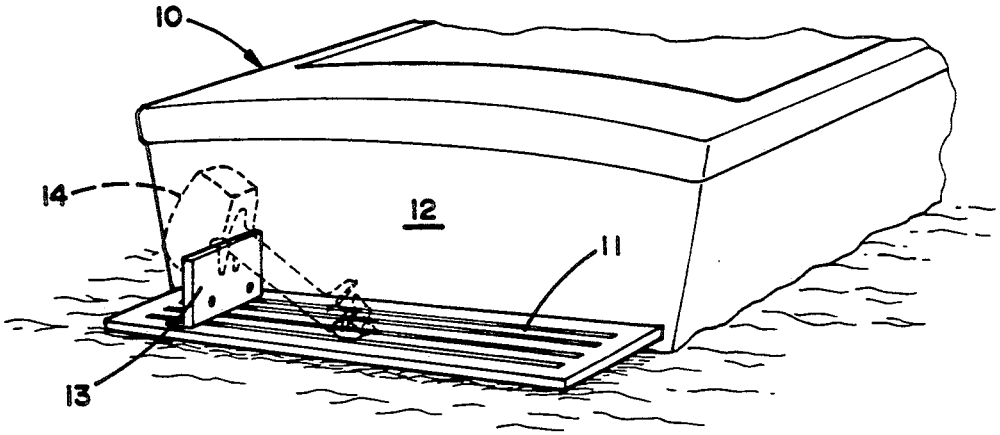
FIG. 1
FIG. 2
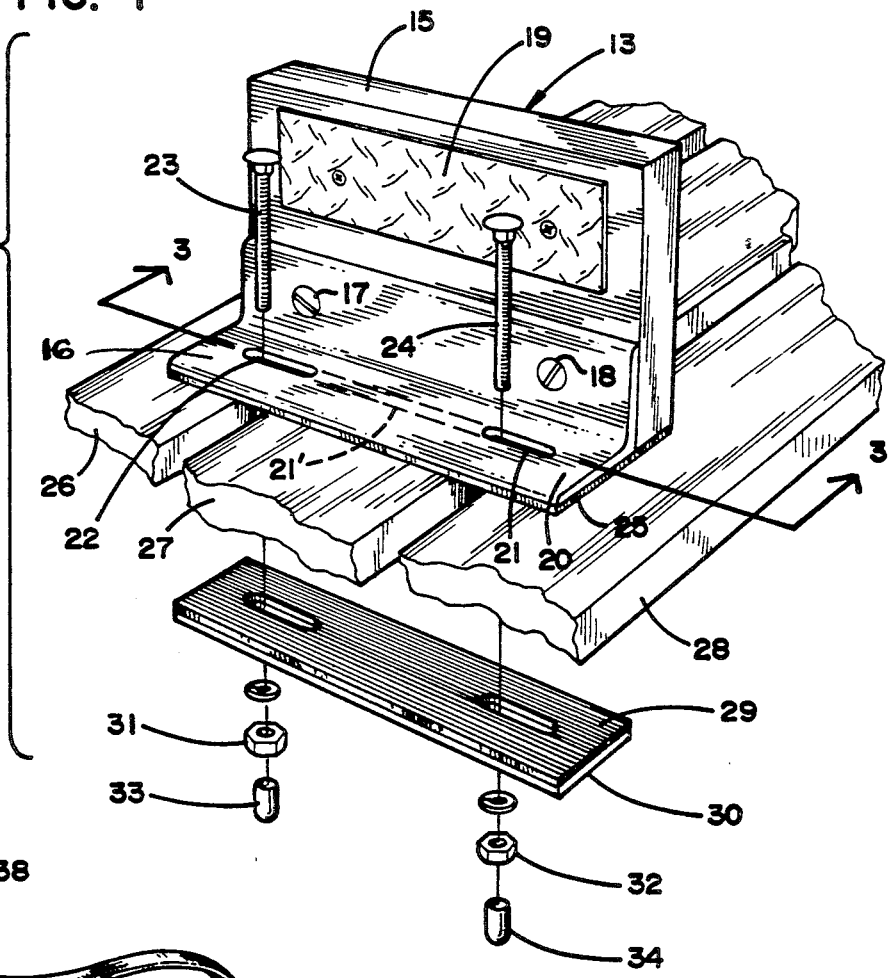
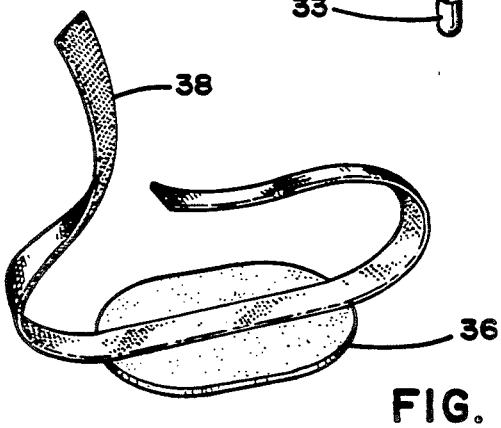
FIG. 4

OUTBOARD MOTOR STOWING BRACKET FOR SLOTTED SWIM PLATFORM

BACKGROUND OF THE INVENTION

A dinghy is a common accessory to a cruising boat, providing transportation to and from an anchorage, and for use in fishing and as a swimming raft. Inflatable dinghies have become very popular, and many of these are provided with structure for mounting an outboard motor. Many cruising boats do not have deck space or lifting equipment to handle a dinghy when underway, so the common practice is to tow the dinghy on the front face of the following stern wave. This tends to subject the motor to water spray or actual immersion, and the buffeting of waves can tear the motor off the dinghy transom, losing the motor and damaging the dinghy. It is a common practice, therefore, to remove the motor when towing a dinghy.

Stowage of outboard motors can be a problem. The motor is sometimes stored on deck, or below deck and sometimes stored on the swim platform of the boat. In any case, the motor is usually unrestrained and tends to slide around, scratching the deck or platform and posing an obstacle or danger to passengers. A mounting bracket or retainer that does not fit different platforms or which requires drilled holes is not acceptable to boat owners or companies that sell boat accessories. An object of the present invention is to provide an adjustable bracket for securing a dinghy motor to a slotted swim platform of a boat that fits on most swim platforms and does not require any drilled holes in the swim platform and protects the swim platform from abrasion.

SUMMARY OF THE INVENTION

A small panel is mounted on the stern or swimming platform of a boat, with the panel in a front-rear vertical plane. The panel is an angular configuration providing a base flange that is bolted to the swimming platform with fastenings traversing the usual open structure of the swimming platform that is customary to provide quick drainage. The mounting clamp of the motor is placed in engagement with this small panel, with the motor lying crosswise with respect to the axis of the boat. The standard outboard motor mounting clamp has a pivot support for the motor, permitting rotation of the motor on a transverse axis so that the propeller can be lifted out of the water. This pivot mounting thus permits the motor to be rotated so that the propeller drive housing can be moved downward toward the swimming platform. A pad is attachable to the drive housing, and is interposed between it and the swimming platform. This stowed position of the motor is thus shielded by the transom of the boat, so that the motor is protected against spray and immersion. It is also readily available to anyone standing on the platform for later transfer back to the dinghy.

DESCRIPTION OF THE DRAWINGS

FIG. 1 is a perspective view of the stern portion of a power boat, taken from the rear, with a motor shown in dotted lines mounted on a stowage bracket secured to the standard swimming platform.

FIG. 2 is an exploded view on an enlarged scale showing the components of the mounting bracket, and their relationship to the swimming platform.

FIG. 4 is a perspective view showing the pad normally secured to the propeller drive housing of the motor, with its securing straps.

DESCRIPTION OF THE PREFERRED EMBODIMENT

Figure 3:
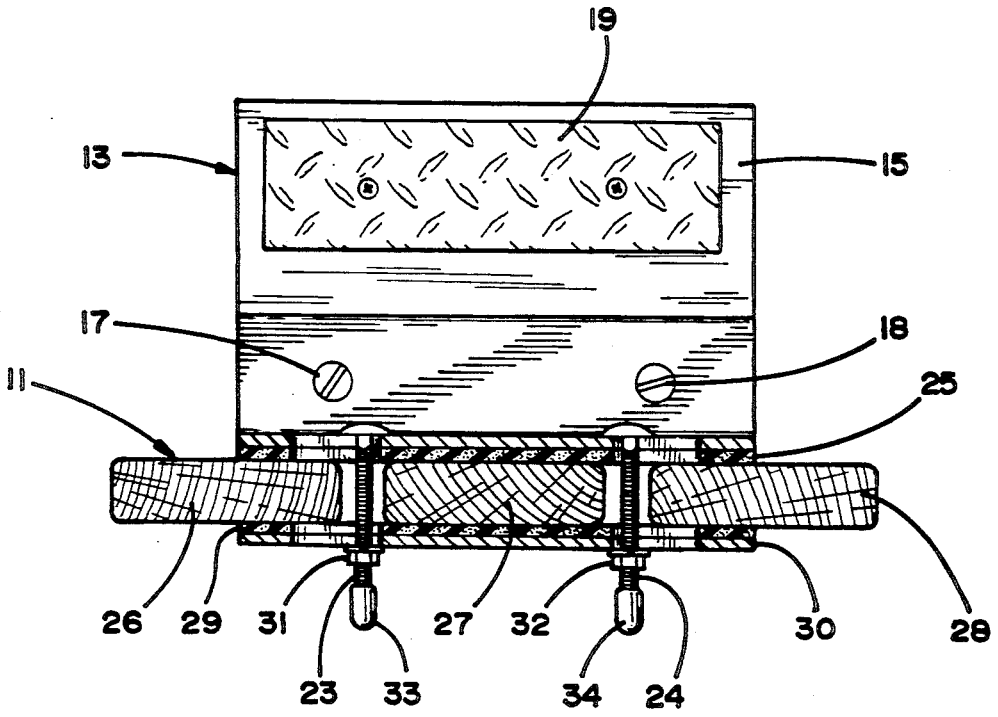
FIG. 3 is a section on the plane 3—3 of FIG. 2.

Referring to FIG. 1, the boat 10 is shown provided with a swimming platform 11 arranged across the lower portion of the transom 12. The mounting bracket 13 is shown secured to the platform 11 to stow the outboard motor generally indicated at 14 when it is not attached to the dinghy. The structure of the mounting bracket is best shown in FIG. 2, and its installed position in FIG. 3. A small panel 15 has an angular base 16 secured to it with screws 17 and 18. An abrasion-resistant pad 19 is secured to the panel 15 with convenient fastenings or adhesive to provide a durable surface for receiving the mounting clamp of an outboard motor. The horizontal flange 20 of the angle member 16 has the elongated openings 21 and 22 for receiving bolts as shown at 23 and 24 traversing these openings, and corresponding openings in the pad 25 (refer to FIG. 3) interposed between the flange 20 and the platform 11. This particular platform is formed by the spaced teak slats 26–28, with the spacing between them providing openings for the passage of the bolts 23 and 24. On the underside of the platform, the bolts traverse the pad 29 and the clamping plate 30, which have elongated openings corresponding to the openings 21 and 22 in the flange 20. The bolts are secured with the nuts 31 and 32, which preferably rest on standard washers bridging across the elongated openings. The lower extremities of the bolts 23 and 24 are preferably covered by plastic caps 33 and 34 to present surfaces that are less dangerous to swimmers.

An important feature of the present invention is that the bracket is mountable on a wide variety of slotted swim platforms of different sizes without drilling any holes and will securely support outboard motors of different sizes. The motor support panel desirable should be at least about eight (8) inches high. At this height, the motor C-clamps can be rotated sufficiently to permit most typical dinghy motors to be secured to the panel while the lower end of the motor rests on the platform. The panel is about twelve (12) inches wide and the angle member extends the width of the panel and has slots that provide a variation in bolt openings of at least two (2) inches and preferably at least about four (4) inches. In the preferred practice of the invention two slots two (2) inches wide are separated by about six (6) inches. The slot lengths, however, do not have to be equal. Indeed a single elongated slot 21' as shown in phantom is FIG. 2 could be employed.

The bolt spacings are provided so that the bracket can be attached without drilled holes to a wide variety of typical swim platforms, which may have slats or boards that vary between about three-eighths ($\frac{3}{8}$) inches and two and one-half ($2\frac{1}{2}$) inches wide. The distance between the boards is typically about an inch or so but this could vary by a quarter to a half inch.

With the bracket of the present invention, virtually any normal dinghy motor can be easily and securely attached to almost any swim platform. The bracket is secured transversely with respect to the swim platform and the stern of the boat about eighteen (18) inches from the end of the swim platform, with the angle mounting bracket facing outward. The upper end of the motor is mounted on the bracket and the lower end extends inwardly toward the center of the swim platform. The motor can be stowed adjacent the stern of the boat so as to create the least obstruction to the use of the swim platform, leaving the rear edge of the swim platform completely open.

Figure 5:
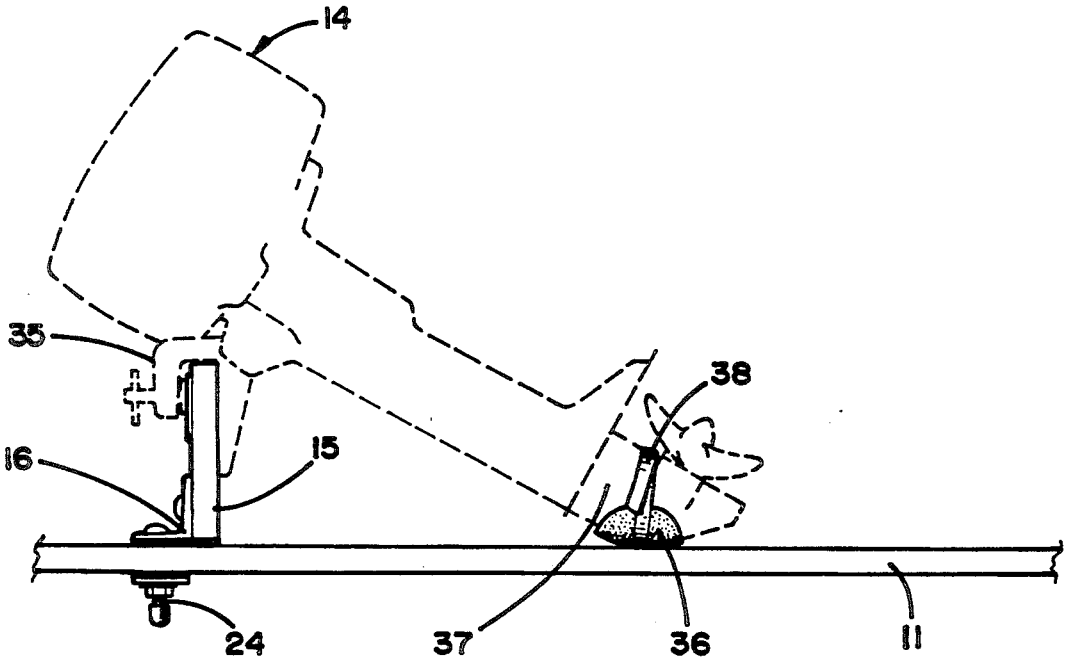
FIG. 5 is a view on an enlarged scale from the rear of the stowed position of the motor shown in dotted lines.

Referring to FIG. 5, the motor 14 is shown with its C-shaped mounting clamp 35 engaging the panel 15 of the stowing bracket. A pad 36 is shown interposed between the propeller drive housing 37 and the platform 11. This pad is secured in place with the Velcro strap 38 (see FIG. 4), which is secured adhesively to the pad 36, so that its ends can be wrapped around the propeller drive housing 37 as shown in FIG. 5. This arrangement protects both the swimming platform and the motor.

I claim:

1. A method of stowing an outboard motor on a boat having a stern platform, said motor having a pivoted mounting clamp and a propeller drive housing, comprising:

securing a vertical panel to said platform in a front-rear plane;

mounting said motor on said panel, and securing said mounting clamp thereto; and securing a pad to said drive housing in position to engage said platform on lowering said housing to pivot said motor on said clamp.

2. A method as defined in claim 1, wherein said platform has transverse openings, and said panel has an angular base providing a horizontal flange bridging across said openings, said method including installing fastenings traversing said flange and openings.

3. A system for stowing an outboard motor on the stern platform of a boat, said platform having at least one aperture, comprising:

an angular bracket providing a horizontal base engageable with said platform and extending across said aperture, said base having at least one corresponding aperture in alignment with said platform aperture, such that the base can be attached to the platform by a fastener that extends through the aligned apertures in the base and stern platform, said bracket also having a normally vertical panel extending upwardly from the base and oriented in a plane perpendicular to the stern of the boat, the panel receiving an outboard motor mounting clamp on an upper end thereof, with the outboard motor oriented parallel to the stern of the boat, the upper end of the panel being spaced close to the platform such that the motor is supported in a generally horizontal position on the platform, with an upper portion of the motor being supported close to the platform by the vertical panel and a lower portion of the motor including a motor propeller extending across the stern of the boat and resting on the platform.

4. A system for stowing an outboard motor on the stern platform of a boat, said platform having at least one aperture, comprising:

an angular bracket providing a horizontal base engageable with said platform and extending across said aperture, said base having at least one corresponding aperture in alignment with said platform aperture, said bracket also having a normally vertical panel disposed in a front-rear plane for receiving an outboard motor mounting clamp, the system additionally including pad means attachable to a lower extremity of an outboard motor in position to be interposed between said platform and said motor.

5. A system as defined in claim 4, in combination with a boat having a stern platform, and with an outboard motor having a mounting clamp and a propeller drive housing, said pad means being secured to said housing.

6. A system for stowing an outboard motor on the stern platform of a boat, said platform having at least one aperture, comprising:

an angular bracket providing a horizontal base engageable with said platform and extending across said aperture, said base having at least one corresponding aperture in alignment with said platform aperture, said bracket also having a normally vertical panel disposed in a front-rear plane for receiving an outboard motor mounting clamp, the stern platform comprising a series of spaced boards that extending longitudinally along the platform parallel to the stern of the boat with slots being formed between the boards, the angular bracket extending over a plurality of slots, the angular bracket having aperture means for receiving at least two fasteners therethrough to secure the bracket to the stern platform, the aperture means including at least one slotted aperture that receives at least one fastener therethrough, the fasteners being positionable in the aperture means such that the fasteners extend through different slots in the swim platform to attach the bracket to the stern platform, the slot in the angle bracket providing a permitted variation in fastener spacing sufficient to permit attachment of the bracket to different platforms having different width boards without drilling holes in the platform.

7. The system according to claim 6 wherein the slots in the brackets permit fastener spacing variation of at least about two (2) inches.

8. A system according to claim 6 and further comprising a clamping plate positioned under the stern platform and opposite the angular plate, the clamping plate having at least one slotted aperture opposite the slotted aperture in the angular bracket, the fasteners comprising bolts that extend through the angular bracket and clamping plate and clamp the system securely on the stern platform by nuts threaded on lower ends of the bolts, the clamping plate and angular bracket being padded so as to reduce scratching of the platform, the angular bracket and clamping plate being elongated and extending over more than one board such that the compression force of the tightened bolts on the platform is spread out over a large surface area, reducing the tendency of the bolts to deform the platform.

9. An adjustable dinghy outboard motor stowing bracket for a swimming platform mounted at the stern of a boat and formed of spaced parallel boards separated by slots, wherein the slots extend parallel to the stern, the apparatus comprising:

an elongated vertical support panel positioned on the swimming platform in a position transverse to the slots on the platform, the vertical support panel having an upper edge capable of having a dinghy outboard motor clamped thereto by a mounting clamp on the motor, the vertical support panel being positioned toward one side of the swimming platform such that an upper end of the motor can rest on the support panel at one side of the platform and a lower end of the motor will extend across the platform in a direction perpendicular to the longitudinal direction of the boat;

an angle member attached to and extending along a lower edge of the support panel and having an outwardly extending horizontal mounting flange that abuts an upper surface of the swimming platform, the mounting flange having elongated slotted opening means therein for receiving at least two spaced releasable fasteners, the opening means being elongated to the extent necessary to permit the spacing of the fasteners to be adjusted so that they will fit through the slots in swimming platforms having different slot configurations without the necessity of drilling new openings in the swimming platform to attach the mounting bracket to the swimming platform;

at least two spaced releasable fasteners extending downwardly through the opening means in the mounting flange and the existing slot openings in the swimming platform and protruding from a lower side thereof;

elongated clamping plate means positioned on the underside of the swimming platform and engaging the platform opposite the angle member, the plate means having slotted opening means through which the fasteners fit such that the openings can align with fasteners extending through platform slots having different spacings; and releasable retainer mounted on the ends of the fasteners for clamping the plate means and mounting flange on opposite sides of the swimming platform to hold the vertical member in an upright, motor supporting position.

* * * * *